US008720521B1

(12) United States Patent
Peary

(10) Patent No.: US 8,720,521 B1
(45) Date of Patent: May 13, 2014

(54) TAPE DISPENSER ASSEMBLY

(76) Inventor: Leonora Peary, East Lismore (AU)

( * ) Notice: Subject to any disclaimer, the term of this patent is extended or adjusted under 35 U.S.C. 154(b) by 46 days.

(21) Appl. No.: 13/447,402

(22) Filed: Apr. 16, 2012

(51) Int. Cl.
*B44C 7/00* (2006.01)
*B29C 65/00* (2006.01)

(52) U.S. Cl.
USPC ..... 156/577; 156/523; 156/527; 156/579; 156/574

(58) Field of Classification Search
USPC ..... 156/523, 527, 577, 579, 574; 225/23, 225/43, 89, 51, 52, 55–62, 84–87, 11–13
See application file for complete search history.

(56) References Cited

U.S. PATENT DOCUMENTS 2,452,584 A * 11/1948 Luebkeman ..... 156/523
3,351,511 A * 11/1967 Petterson ..... 156/527
3,829,346 A 8/1974 Sullivan
4,582,558 A 4/1986 Antonson
4,853,074 A 8/1989 Manusch et al.
5,595,626 A 1/1997 Yokouchi et al.
5,772,840 A 6/1998 Morinaga
D418,165 S 12/1999 Katami
6,453,968 B1 * 9/2002 Hsu ..... 156/577
7,117,915 B2 10/2006 Rolion
D555,200 S 11/2007 Ono

* cited by examiner

*Primary Examiner* — Philip Tucker
*Assistant Examiner* — Alex Efta

(57) ABSTRACT

A tape dispenser assembly facilitates dispensing and cutting tape. The assembly includes a housing having side panels and upper wall and lower walls extending between the side panels. The upper and lower walls are spaced defining an interior space therebetween. A forward edges of the upper and lower walls form a dispensing opening in the housing. A tape formed into a roll positioned in the interior space. The roll of tape has a free end extendable through the dispensing opening. A roller assembly coupled to the housing includes a roller positioned proximate the dispensing opening. A non-sticky side of the tape abuts the roller proximate the free end of the tape. A blade is positioned proximate the roller assembly to cut the tape by manipulating the housing such that the blade engages the tape.

11 Claims, 3 Drawing Sheets

FIG. 3
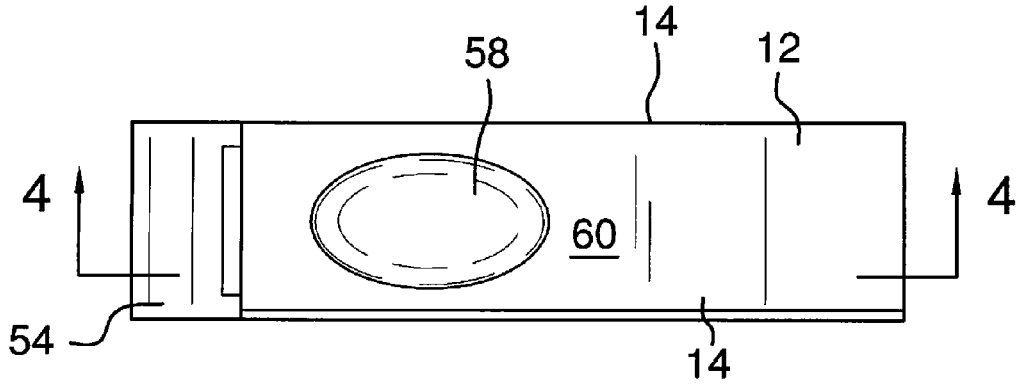
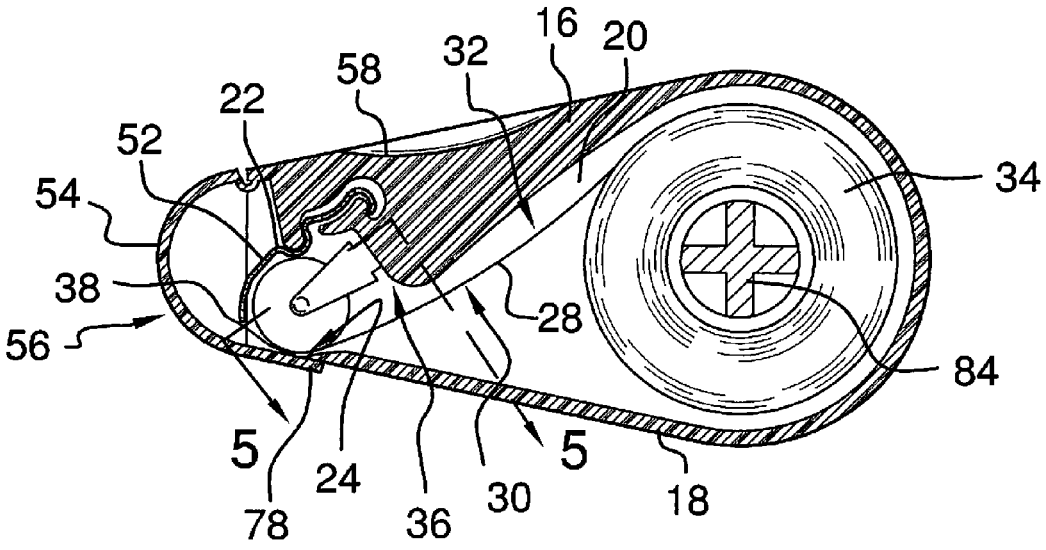
FIG. 4

TAPE DISPENSER ASSEMBLY

BACKGROUND OF THE DISCLOSURE

Field of the Disclosure

The disclosure relates to tape dispenser devices and more particularly pertains to a new tape dispenser device for facilitating dispensing and cutting of tape.

SUMMARY OF THE DISCLOSURE

An embodiment of the disclosure meets the needs presented above by generally comprising a housing having a pair of spaced side panels, an upper wall extending between the side panels, and a lower wall extending between the side panels. The upper wall and the lower wall is spaced to define an interior space therebetween. A forward edge of the upper wall and a forward edge of the lower wall are spaced forming a dispensing opening in the housing. A tape having a sticky side and a non-sticky side is formed into a roll positioned in the interior space. The roll of tape has a free end extendable through the dispensing opening. A roller assembly is coupled to the housing and includes a roller positioned proximate the dispensing opening. The non-sticky side of the tape abuts the roller proximate the free end of the tape. A blade is coupled to the housing and positioned proximate the roller assembly whereby the blade selectively engages and cuts the free end of the roll of the tape when the free end of the roll of the tape is extended from the roller and the housing is manipulated such that the blade engages the tape.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 3 is a top view of an embodiment of the disclosure.

FIG. 4 is a cross-sectional view of an embodiment of the disclosure taken along line 4-4 of FIG. 3.

DESCRIPTION OF THE PREFERRED EMBODIMENT

Figure 1:
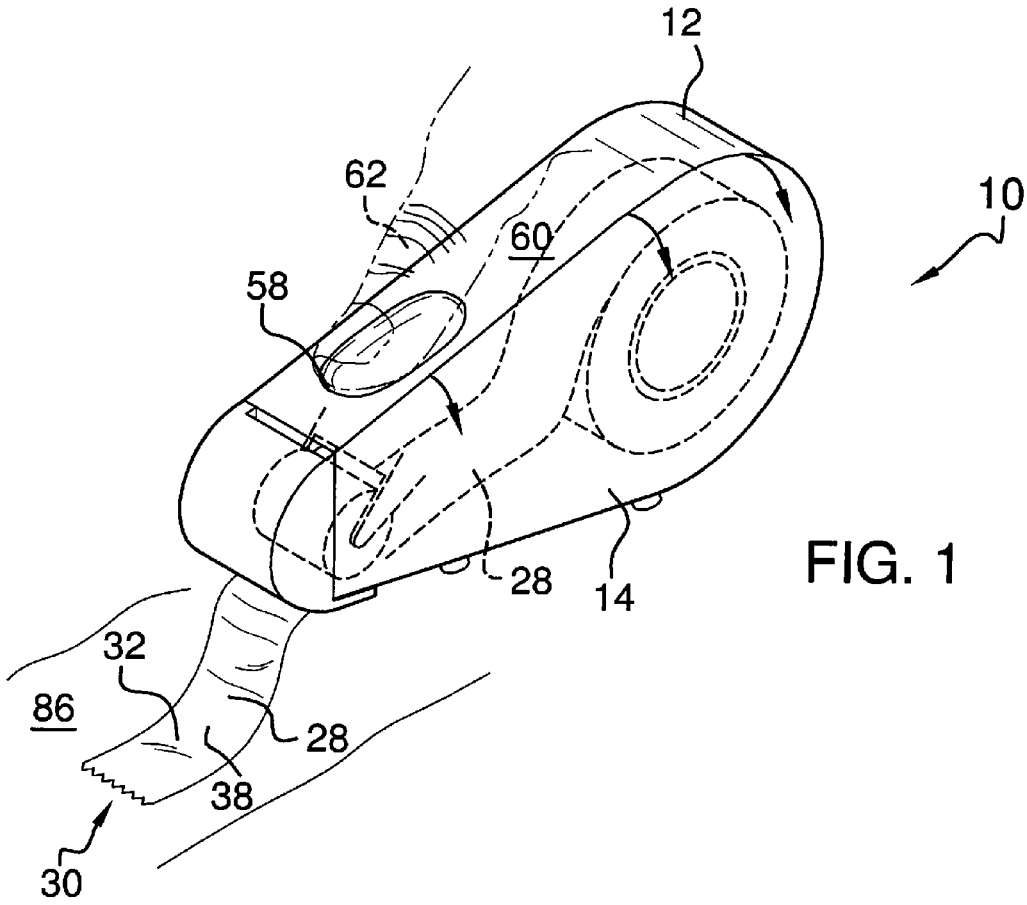
FIG. 1 is a top front side perspective view of a tape dispenser assembly according to an embodiment of the disclosure.
Figure 2:
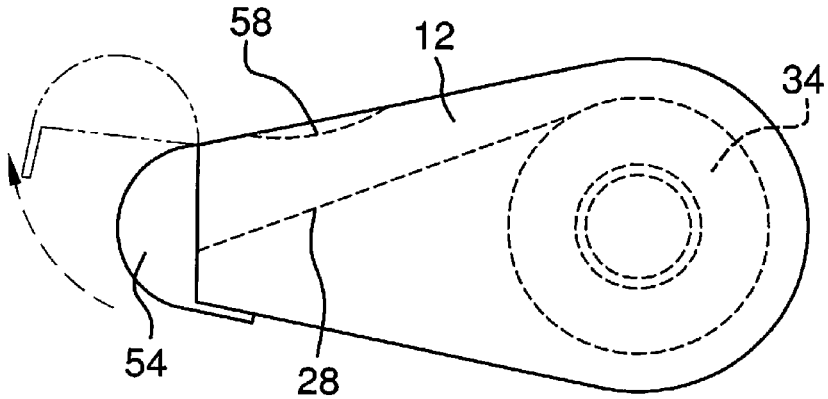
FIG. 2 is a side view of an embodiment of the disclosure.
Figure 5:
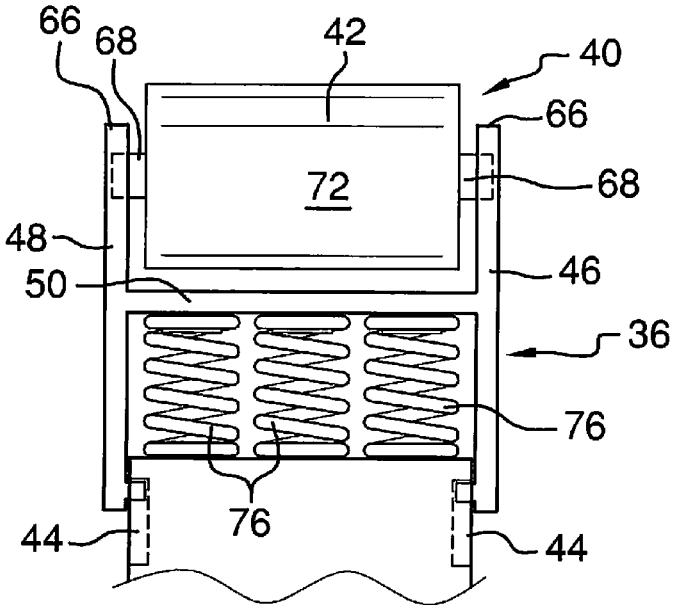
FIG. 5 is a cross-sectional view of an embodiment of the disclosure taken along line 5-5 of FIG. 4.
Figure 6:
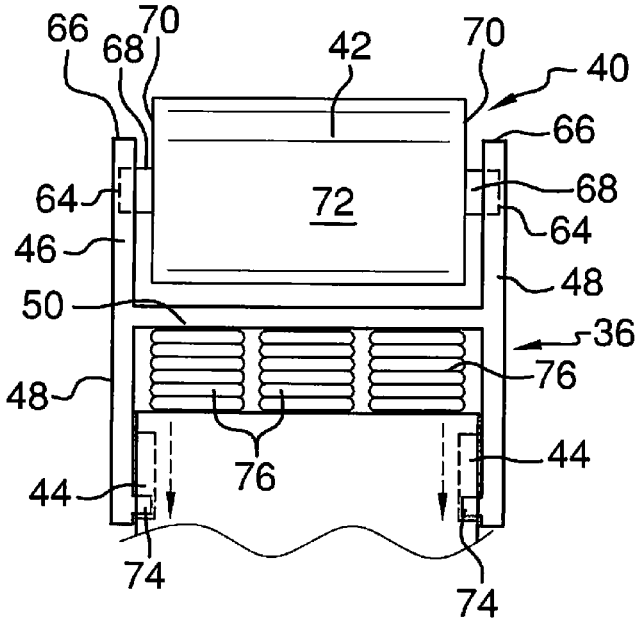
FIG. 6 is a cross-sectional view of an embodiment of the disclosure taken along line 6-6 of FIG. 1.

With reference now to the drawings, and in particular to FIGS. 1 through 6 thereof, a new tape dispenser device embodying the principles and concepts of an embodiment of the disclosure and generally designated by the reference numeral 10 will be described.

As best illustrated in FIGS. 1 through 6, the tape dispenser assembly 10 generally comprises a housing 12 having a pair of spaced side panels 14, an upper wall 16 extending between the side panels 14 and a lower wall 18 extending between the side panels 14. The upper wall 16 and the lower wall 18 are spaced to define an interior space 20 therebetween. A forward edge 22 of the upper wall 16 and a forward edge 24 of the lower wall 18 are spaced forming a dispensing opening 26 in the housing 12. A tape 28 is provided having a sticky side 30 and a non-sticky side 32. The tape 28 is formed into a roll 34 of the tape 28 and positioned in the interior space 20. The roll 34 of the tape 28 has a free end 38 extendable through the dispensing opening 26. The forward edge 24 of the lower wall 18 is flat such that the sticky side 30 of the tape 28 may engage the forward edge 24 of the lower wall 18 to hold the free end 38 away from the roll 34. One of the side panels 14 of the housing 12 is pivotally coupled to either one of the upper wall 16 and the lower wall 18 for accessing the interior space 20 to permit replacement of the roll 34 of the tape 28.

A roller assembly 40 is coupled to the housing 12. The roller assembly 40 is more specifically coupled to and extends from the upper wall 16. The roller assembly 40 includes a roller 42 positioned proximate the dispensing opening 26. The non-sticky side 32 of the tape 28 abuts the roller 42 proximate the free end 38 of the tape 28. The roller assembly 40 includes a holder 46. The roller 42 is coupled to the holder 46 and the holder 46 is coupled to the upper wall 16. The upper wall 16 includes a pair of slots 44. The slots 44 are positioned proximate the roller assembly 40. The holder 46 has a pair of opposed sides 48 and a medial wall 50 extending between the sides 48 of the holder 46. A pair of sockets 64 extend into the sides 48 of the holder 46. The sockets 64 are positioned proximate a distal end 66 of the sides 48 relative to the upper wall 16. A pair of aligned projections 68 extend from opposite ends 70 of the roller 42. The projections 68 extend into the sockets 64 whereby the roller 42 is coupled to the holder 46.

A biasing assembly 70 is coupled to the holder 46 and the upper wall 16. Thus, the roller 42 is urged outwardly from the upper wall 16 into the dispenser opening 26. The forward edge 24 of the lower wall 18 faces an outer surface 72 of the roller 42. The outer surface 72 of the roller 42 urges the tape 28 into contact with the forward edge 24 of the lower wall 18 when the roller 42 is biased outwardly by the biasing assembly 70. The biasing assembly 70 is also compressible such that the outer surface 72 of the roller 42 is moved into a spaced relationship to the forward edge 24 of the lower wall 18 such that the tape 28 is dispensable through the dispensing opening 26. A pair of extensions 74 project inwardly from the sides 48 of the holder 46. The extensions 74 are positioned proximate to and engage the slots 44 in the upper wall 16. A biasing member 76 is coupled to and positioned between the medial wall 50 of the holder 46 and the upper wall 16 whereby the holder 46 is urged outwardly from the upper wall 16. A plurality of biasing members 76 may also be employed.

A blade 52 is coupled to the housing 12, more specifically being coupled to and extending from the upper wall 16. The blade 52 is positioned proximate the roller assembly 40 whereby the blade 52 may engage and cut the tape 28 proximate the free end 38 of the tape 28 when the free end 38 of the tape 28 is extended from the roller 42 through the dispensing opening 26 and the housing 12 is manipulated such that the blade 52 engages the tape 28. A depression 58 is provided in an upper surface 60 of the upper wall 16 for receiving a thumb 62 of a user when the housing 12 is grasped to dispense the tape 28. A cap 54 may be coupled to the housing 12. The cap 54 is positioned proximate the blade 52 for selectively covering the blade 52 when the cap 54 is in a closed position 56. An end 78 of the cap overlaps the forward edge 24 when in the closed position 56 protecting the tape 28 from debris between uses.

The housing 12 may be fully or partially transparent to permit viewing of the roll 34 of the tape 28 while still held in the interior space 20 without pivoting one of the side panels 14. A spindle 84 may be coupled to the housing 12 and positioned in the interior space 20. The roll 34 of the tape 28 is positioned on the spindle 84 to facilitate stable dispensation of the tape 28 from the roll 34 during use.

In use, the roll 34 of tape 28 is installed into the housing 12 and the free end 38 of the tape 28 is extended through the dispensing opening 26. The tape 28 is pinched between the roller 42 and the forward edge 24 of the lower wall 18 to hold the free end 38 adjacent to the roller 42. The tape 28 is dispensed by grasping the housing 12 and pushing the tape 28 and roller 42 against a surface 86 to which the tape 28 is being attached. When a sufficient amount of the tape 28 is attached, the housing is manipulated by pivoting the housing 12 relative to the surface 86 urging the tape 28 into contact with the blade 52. The blade 52 cuts the tape 28 and the housing 12 is pulled away from the surface 86 and the biasing assembly 70 urges the sticky side 30 of the tape 28 against the forward edge 24 of the lower wall 18 to hold the tape 28 in place until the next use. The cap 54 is used as desired to cover the blade 52 when not in use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A tape dispenser assembly comprising:

a housing having a pair of spaced side panels, an upper wall extending between said side panels, and a lower wall extending between said side panels, said upper wall and said lower wall being spaced to define an interior space therebetween, a forward edge of said upper wall and a forward edge of said lower wall being spaced forming a dispensing opening in said housing;

a tape having a sticky side and a non-sticky side, said tape being formed into a roll of said tape positioned in said interior space, said roll of said tape having a free end extendable through said dispensing opening;

a roller assembly coupled to said housing, said roller assembly including a roller positioned proximate said dispensing opening, said non-sticky side of said tape abutting said roller proximate said free end of said tape; and a blade coupled to said housing, said blade being positioned proximate said roller assembly whereby said blade selectively engages and cuts said free end of said roll of said tape when said free end of said roll of said tape is extended from said roller and said housing is manipulated relative to said tape such that said blade engages said tape, said blade being retained in a fixed position relative to said housing such that said blade is in a same position when said tape is engaged with blade as when tape is not being engaged with said blade;

said roller assembly being coupled to and extending from said upper wall;

said roller assembly including a holder, said roller being coupled to said holder, said holder being coupled to said upper wall;

a biasing assembly coupled to said holder and said upper wall whereby said roller is urged outwardly from said upper wall into said dispenser opening;

said holder having a pair of opposed sides and a medial wall extending between said sides of said holder, a pair of sockets extending into said sides of said holder, said sockets being positioned proximate a distal end of said sides relative to said upper wall;

a pair of aligned projections extending from opposite ends of said roller, said projections extending into said sockets whereby said roller is coupled to said holder;

said upper wall including a pair of slots positioned proximate said roller assembly;

a pair of extensions projecting inwardly from said sides of said holder, said extensions being positioned proximate to and engaging said slots in said upper wall; and a biasing member of said biasing assembly being coupled to and positioned between said medial wall of said holder and said upper wall whereby said holder is urged outwardly from said upper wall.

2. The assembly of claim 1, further said blade being coupled to and extending from said upper wall.

3. The assembly of claim 1, further including a cap coupled to said housing, said cap being positioned proximate said blade for selectively covering said blade when said cap is in a closed position.

4. The assembly of claim 1, further including a depression in an upper surface of said upper wall whereby said depression is configured for receiving a thumb of a user.

5. The assembly of claim 1, further including an outer surface of said roller urging said tape into contact with said forward edge of said lower wall when said roller is biased outwardly by said biasing assembly.

6. The assembly of claim 5, further including said biasing assembly being compressible such that said outer surface of said roller is moved into a spaced relationship to said forward edge of said lower wall whereby said tape is dispensable through said dispensing opening.

7. The assembly of claim 5, further including said forward edge of said lower wall being flat.

8. The assembly of claim 7, further including said forward edge of said lower wall facing said outer surface of said roller.

9. The assembly of claim 1, further including one of said side panels of said housing being pivotally coupled to one of said upper wall and said lower wall for accessing said interior space whereby said roll of said tape is replaceable.

10. The assembly of claim 1, further including a spindle coupled to said housing, said spindle being positioned in said interior space, said roll of said tape being positioned on said spindle.

11. A tape dispenser assembly comprising:

a housing having a pair of spaced side panels, an upper wall extending between said side panels, and a lower wall extending between said side panels, said upper wall and said lower wall being spaced to define an interior space therebetween, a forward edge of said upper wall and a forward edge of said lower wall being spaced forming a dispensing opening in said housing, said forward edge of said lower wall being flat, said upper wall including a pair of slots;

a tape having a sticky side and a non-sticky side, said tape being formed into a roll of said tape positioned in said interior space, said roll of said tape having a free end extendable through said dispensing opening, one of said side panels of said housing being pivotally coupled to one of said upper wall and said lower wall for accessing said interior space whereby said roll of said tape is replaceable;

a roller assembly coupled to said housing, said roller assembly being coupled to and extending from said upper wall, said roller assembly including a roller positioned proximate said dispensing opening, said non-sticky side of said tape abutting said roller proximate said free end of said tape, said slots being positioned proximate said roller assembly, said roller assembly including a holder, said roller being coupled to said holder, said holder being coupled to said upper wall, said holder having a pair of opposed sides and a medial wall extending between said sides of said holder;

a blade coupled to said housing, said blade being coupled to and extending from said upper wall, said blade being positioned proximate said roller assembly whereby said blade selectively engages and cuts said free end of said roll of said tape when said free end of said roll of said tape is extended from said roller and said housing is manipulated such that said blade engages said tape;

a cap coupled to said housing, said cap being positioned proximate said blade for selectively covering said blade when said cap is in a closed position; a depression in an upper surface of said upper wall whereby said depression is configured for receiving a thumb of a user;

a pair of sockets extending into said sides of said holder, said sockets being positioned proximate a distal end of said sides relative to said upper wall;

a biasing assembly coupled to said holder and said upper wall whereby said roller is urged outwardly from said upper wall into said dispenser opening, said forward edge of said lower wall facing an outer surface of said roller, said outer surface of said roller urging said tape into contact with said forward edge of said lower wall when said roller is biased outwardly by said biasing assembly, said biasing assembly being compressible such that said outer surface of said roller is moved into a spaced relationship to said forward edge of said lower wall whereby said tape is dispensable through said dispensing opening, said biasing assembly including a biasing member coupled to and positioned between said medial wall of said holder and said upper wall whereby said holder is urged outwardly from said upper wall;

a spindle coupled to said housing, said spindle being positioned in said interior space, said roll of said tape being positioned on said spindle;

a pair of aligned projections extending from opposite ends of said roller, said projections extending into said sockets whereby said roller is coupled to said holder; and a pair of extensions projecting inwardly from said sides of said holder, said extensions being positioned proximate to and engaging said slots in said upper wall.

* * * * *